US009839262B1

(12) United States Patent
Rennard

(10) Patent No.: US 9,839,262 B1
(45) Date of Patent: Dec. 12, 2017

(54) CUFF LINK ACCESSORY

(71) Applicant: Carl J. Rennard, Lincoln, RI (US)

(72) Inventor: Carl J. Rennard, Lincoln, RI (US)

( * ) Notice: Subject to any disclaimer, the term of this patent is extended or adjusted under 35 U.S.C. 154(b) by 0 days.

(21) Appl. No.: 15/185,278

(22) Filed: Jun. 17, 2016

(51) Int. Cl.
*A44B 5/02* (2006.01)
*A44B 1/04* (2006.01)
*A44B 1/18* (2006.01)

(52) U.S. Cl.
CPC ..... *A44B 5/02* (2013.01); *A44B 1/04* (2013.01); *A44B 1/18* (2013.01)

(58) Field of Classification Search
CPC .... A44B 5/02; A44B 1/18; A44B 1/04; A41B 3/02; A41B 7/02; A41B 7/04
See application file for complete search history.

(56) References Cited

U.S. PATENT DOCUMENTS 2,585,689 A * 2/1952 Schafer ..... A41B 3/02 2/127
2,585,690 A * 2/1952 Schafer ..... A41B 3/02 2/127
3,106,719 A * 10/1963 Rosenfeld ..... A41B 3/02 2/116
4,528,726 A 7/1985 Kurashima
4,546,494 A * 10/1985 Garber ..... A41D 25/005 2/144
4,580,298 A * 4/1986 Tuisl ..... A41F 9/025 2/220
4,827,576 A * 5/1989 Prince, Jr. ..... A44B 6/00 2/145
6,588,067 B2 7/2003 Efron et al.
D610,327 S * 2/2010 Cavarra ..... D2/639
8,220,111 B2 7/2012 Poliakoff
8,266,723 B2 * 9/2012 Frandsen ..... A41F 9/02 2/237
8,474,065 B2 * 7/2013 Kingsbury ..... A44B 1/08 2/221
8,763,164 B2 * 7/2014 MacGillivray ..... A41D 1/06 2/221
2002/0066132 A1 * 6/2002 Rindle ..... A41D 3/02 2/22
2009/0083896 A1 * 4/2009 Park ..... A41B 3/02 2/140
2012/0005862 A1 * 1/2012 Severyn ..... A44B 5/00 24/102 SL
2013/0318683 A1 * 12/2013 Blakely ..... A41B 7/10 2/124
2014/0189935 A1 * 7/2014 Tucker ..... A41D 27/08 2/244
2015/0033449 A1 * 2/2015 Goel ..... A41B 7/02 2/243.1
2015/0033450 A1 * 2/2015 Goel ..... A41B 7/02 2/243.1

(Continued)

*Primary Examiner* — Robert Sandy
*Assistant Examiner* — Rowland Do
(74) *Attorney, Agent, or Firm* — Salter & Michaelson

(57) ABSTRACT

A cuff link accessory for coupling a one piece cuff link with a shirt cuff button and button hole, and including a base member having opposed ends, a first hole section disposed at one end of the base member and a second hole section disposed at the opposed end of the base member. The first hole section is for engagement with a post of the cuff link, once inserted through button hole, and the second hole section is for engagement with the shirt cuff button.

22 Claims, 9 Drawing Sheets

(56) References Cited

U.S. PATENT DOCUMENTS

| | | | | |
|---|---|---|---|---|
| 2015/0237919 | A1* | 8/2015 | Chen | A41B 7/02 2/270 |
| 2015/0359299 | A1* | 12/2015 | Castro | A44B 6/00 24/66.7 |

* cited by examiner

FIG. 15

FIG. 16

FIG. 17

FIG. 18

CUFF LINK ACCESSORY

FIELD OF THE INVENTION

The present invention relates in general to a cuff link accessory. More particularly, the present invention relates to a cuff link accessory that is useful in applying a cuff link to a shirt having a button cuff.

BACKGROUND OF THE INVENTION

At the present time there are basically two ways of connecting a cuff on a shirt. One way is to use the conventional button and button hole and multiple buttons and multiple button holes. The other way to connect the cuff is with the use of a cuff link that typically passes through opposed holes at ends of the cuff.

It is an object of the present invention to provide an accessory whereby a buttoned cuff shirt can be converted for use with a cuff link.

Another object of the present invention is to provide a cuff link accessory for coupling a one piece cuff link with a shirt cuff button, particularly the button hole. Still another object of the present invention is to provide a cuff link accessory that is relatively simple in construction, that can be manufactured relatively inexpensively and that can be readily installed.

A further object of the present invention is to provide a cuff link accessory for coupling a cuff link with a buttoned cuff shirt thus essentially converting the buttoned cuff to allow a wide variety of cuff link configurations to be used.

SUMMARY OF THE INVENTION

To accomplish the foregoing and other objects of the present invention there is provided a cuff link accessory for coupling a one piece cuff link with a shirt cuff button and including a base member having opposed ends, a first hole section disposed at one end of the base member and a second hole section disposed at the opposed end of the base member. The first hole section is for engagement with a post of the cuff link, and the second hole section is for engagement with the shirt cuff button.

In accordance with other aspects of the present invention the base member comprises a planar substrate constructed of a pliable material; the first and second hole sections are each comprised of a single hole; the single hole is in the form of an elongated slit; at least one of the single holes is in the form of a substantially circular hole; the base member comprises a planar substrate constructed of a pliable material and the diameter of the circular hole is less than a diameter of the shirt cuff button so that the shirt cuff button is engageable with the substantially circular hole and retained thereby; in an alternate embodiment the base member comprises a center member and the hole sections are comprised of respective end loops supported from opposite ends of the center member; wherein the shirt cuff is folded back and the base member is arranged under the folded back shirt cuff; wherein, upon the shirt cuff being folded back, the shirt cuff button is disposed under the folded back shirt cuff and between the folded back shirt cuff and a shirt sleeve from which the shirt cuff extends; wherein the cuff link is comprised of an ornamental face piece attached to the post at one end thereof and a toggle hinged from the post at an opposite end thereof; wherein, when the post is engaged with the first hole section, the toggle is in line with the post, and thereafter the toggle is pivoted in order to secure the cuff link with the first hole section; wherein the cuff link is comprised of an ornamental face piece attached to the post at one end thereof and a toggle hinged from the post at an opposite end thereof; and wherein, when the post is engaged with the first hole section, the toggle is in line with the post, and thereafter the toggle is pivoted in order to secure the cuff link with the first hole section. In another version of the present invention there is provided a method of applying a cuff link, that has an ornamental face piece, a post and a toggle, to a shirt having a cuff with a button on one side and a hole on an opposed side by means of a cuff link accessory that includes a base member having opposed ends, a first hole section disposed at one end of the base member and a second hole section disposed at the opposed end of the base member. The method includes folding back the shirt cuff, engaging the cuff link post through the button hole and the first hole section of the base member, and engaging the shirt cuff button with the second hole section.

In accordance with other aspects of the method of the present invention, when the post is engaged with the first hole section, the toggle is in line with the post; wherein thereafter the toggle is pivoted in order to secure the cuff link with the first hole section and the button hole; wherein, upon the shirt cuff being folded back, the shirt cuff button is disposed under the folded back shirt cuff; wherein, upon the shirt cuff being folded back, the shirt cuff button is disposed between the folded back shirt cuff and a shirt sleeve from which the shirt cuff extends; including providing the base member as a planar substrate constructed of a pliable material; or alternatively including providing the base member as a center member and the hole sections as respective end loops supported from opposite ends of the center member.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 15 is a front view of the cuff link accessory of FIG. 1;

FIG. 16 is a rear view of the cuff link accessory of FIG. 1;

FIG. 17 is a left side view of the cuff link accessory of FIG. 1; and

FIG. 18 is a right side view of the cuff link accessory of FIG. 1.

DETAILED DESCRIPTION

Figure 1:
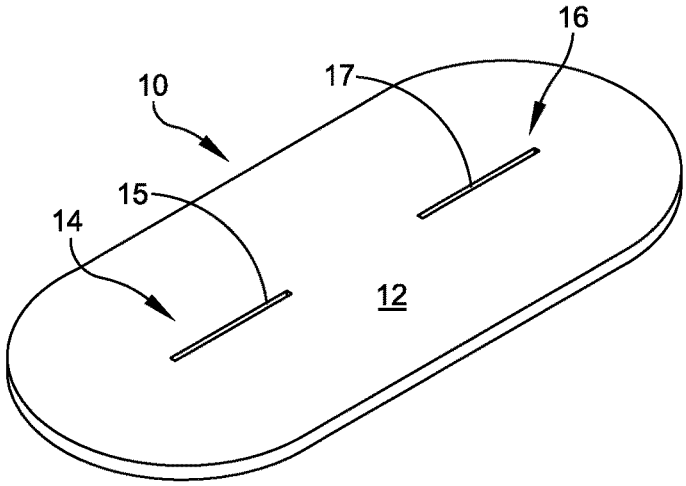
FIG. 1 is a perspective view of a first embodiment of the cuff link accessory of the present invention.
Figure 2:
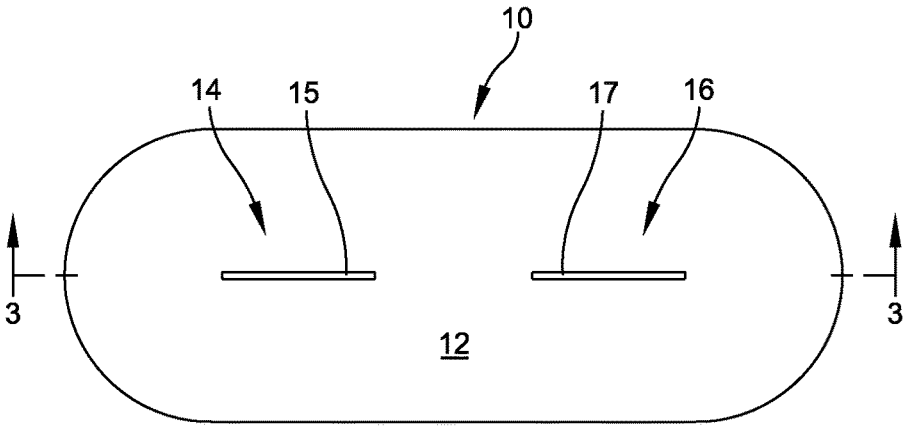
FIG. 2 is a plan view of the Cuff link accessory of FIG. 1.
Figure 3:
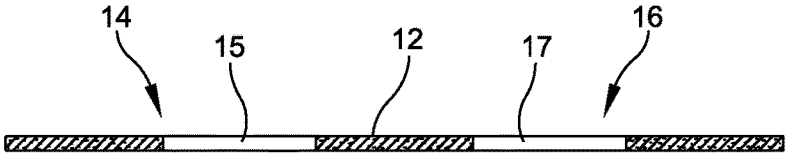
FIG. 3 is a cross section view taken along line 3-3 of FIG. 2

Reference is now made to FIGS. 1-3 of the present invention showing a first embodiment of the cuff link accessory 10. In this embodiment, as well as in other embodiments, such as described in FIGS. 11-14, the accessory may be constructed of a number of different types of material. The accessory 10 is constructed of a pliable material so that it can be readily bent into different shapes. As an example, the accessory may be constructed of leather, suede, alligator, neoprene, a fabric material, rubber or silicone. The length of the accessory may be on the order of 2 inches or in a range of 1.5-2.5 inches. The width of the accessory may be around ¾ of an inch or in a range of 0.5 to 1.0 inch. The length of the slits shown in FIG. 1 in the accessory may have a length that is substantially the same as the distance between the split.

Figure 5:
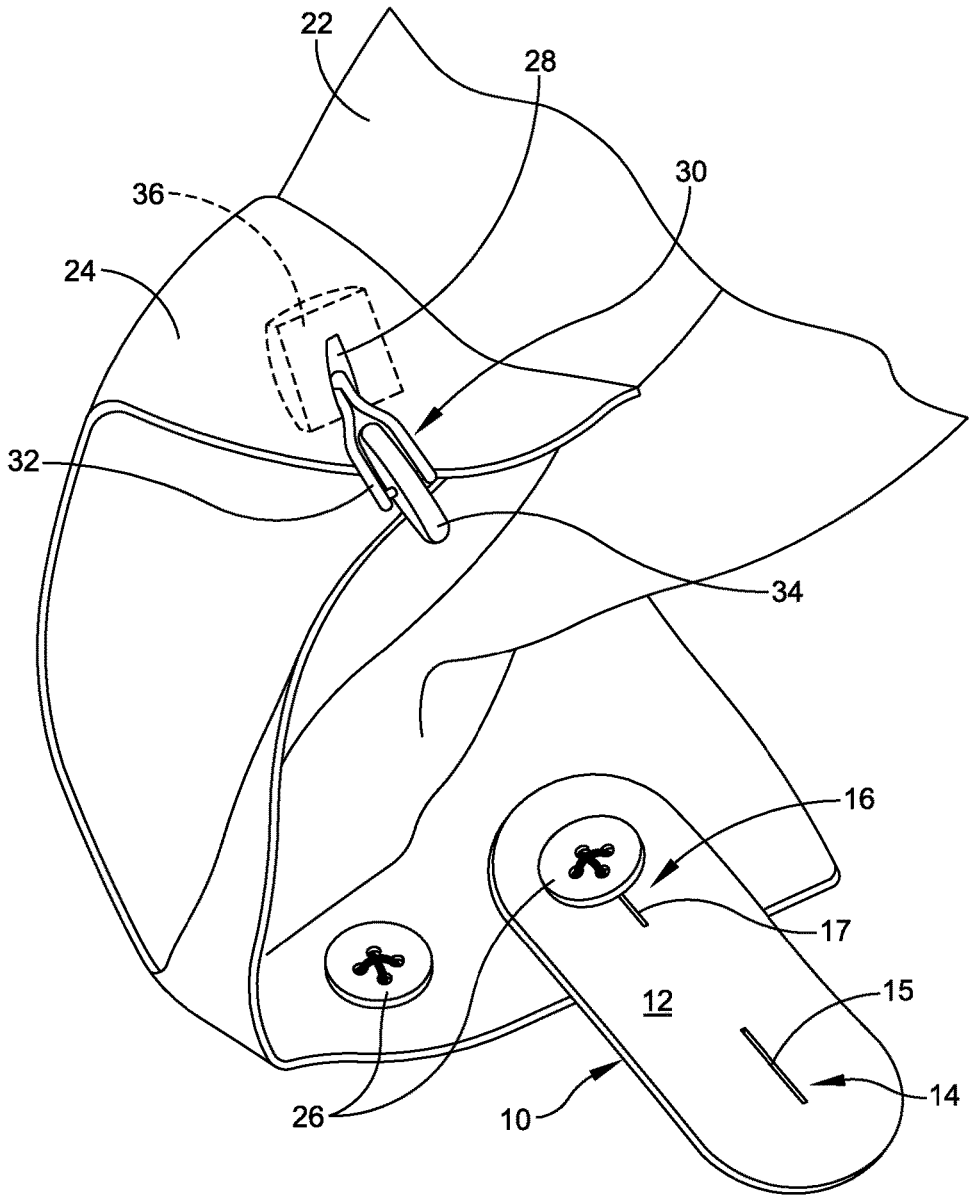
FIG. 5 is a fragmentary perspective view illustrating a next step in the method of installation of the accessory whereby one side of the accessory is connected with the button.
Figure 6:
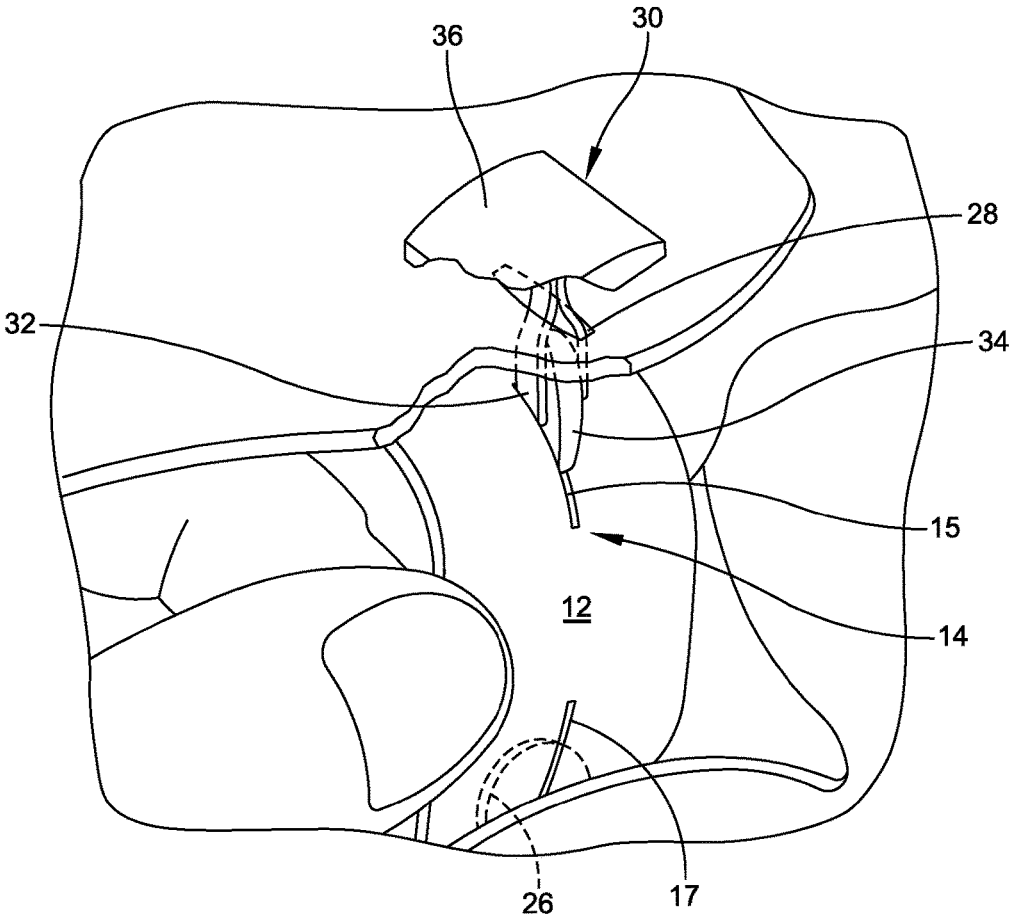
FIG. 6 is a further perspective view illustrating a next step in the method illustrating the other end of the accessory being grasped.
Figure 7:
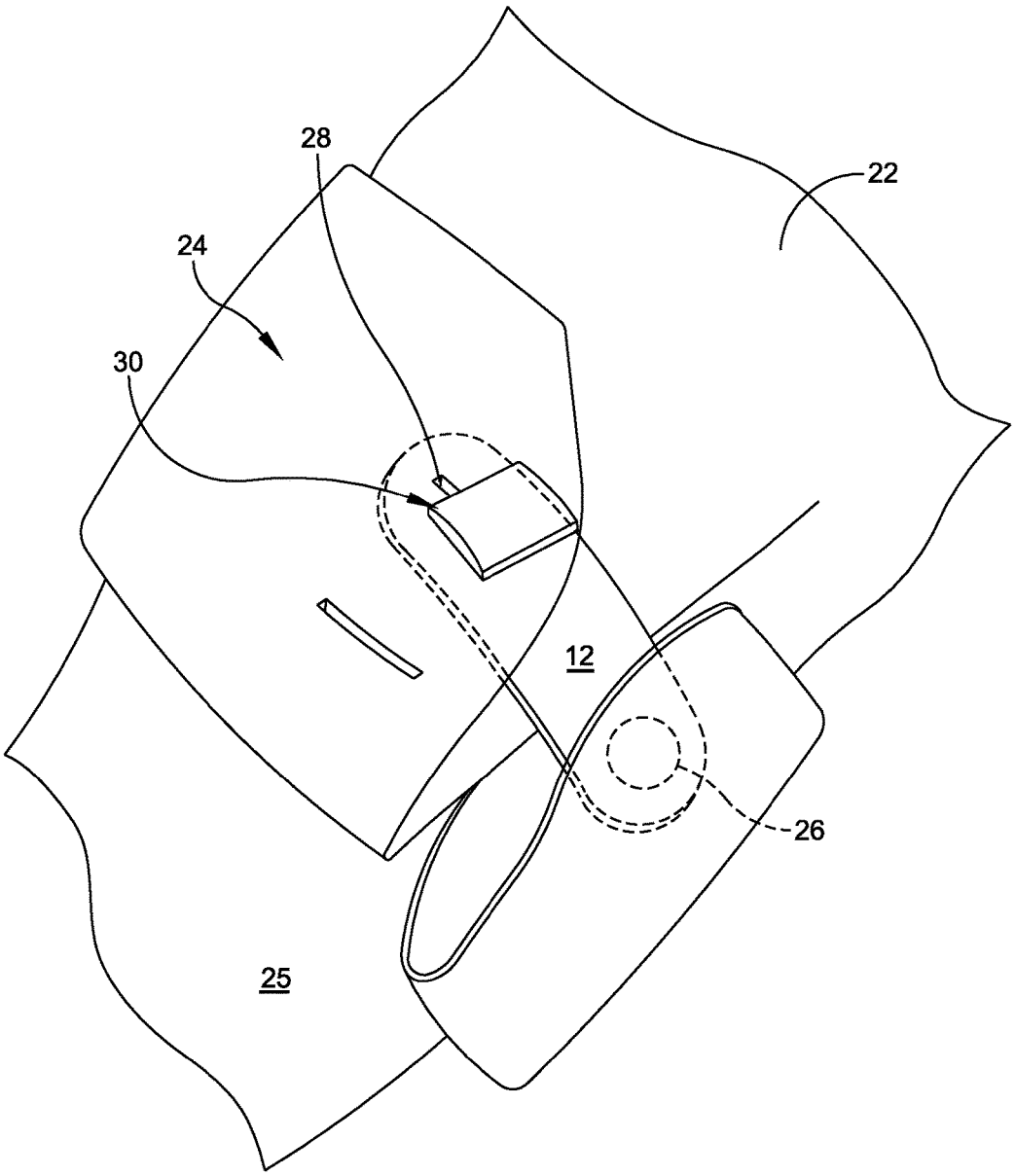
FIG. 7 is a perspective view of a further step in the method wherein the post of the cuff link is inserted through the opposed slit of the accessory.

The cuff link accessory 10 shown in FIGS. 1-3 is comprised of a base member 12 having opposed ends, a first hole section 14 disposed at one end of the base member and a second hole section 16 disposed at the opposed end of the base member. The first hole section is for engagement with a post of the cuff link such as shown in FIG. 7. The second hole section is for engagement with the shirt cuff button such as illustrated in FIGS. 5 and 6. In order to perform this installation of the accessory, the shirt cuff is folded back as illustrated in FIG. 4.

Figure 13:
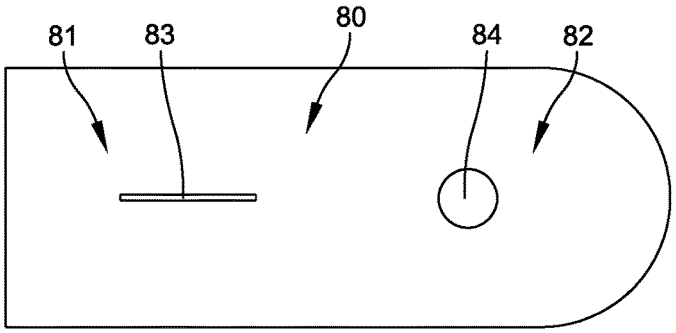
FIG. 13 is a plan view of a fourth embodiment of the cuff link accessory.

As further illustrated in FIGS. 1-3, the base member is a planar substrate material constructed of a pliable material. The first and second hole sections are each comprised of a single hole or slit. FIGS. 1-3 show the use of opposed slits. However, a hole may also be employed such as illustrated in FIG. 13. With respect to the embodiment in FIG. 13, both of the holes may be circular. As a matter of fact, a number of different variations of configuration of the holes can be provided including slits, circular holes, oval holes and other hole configurations. In FIGS. 1-3 there are provided elongated slits 15 and 17.

Figure 4:
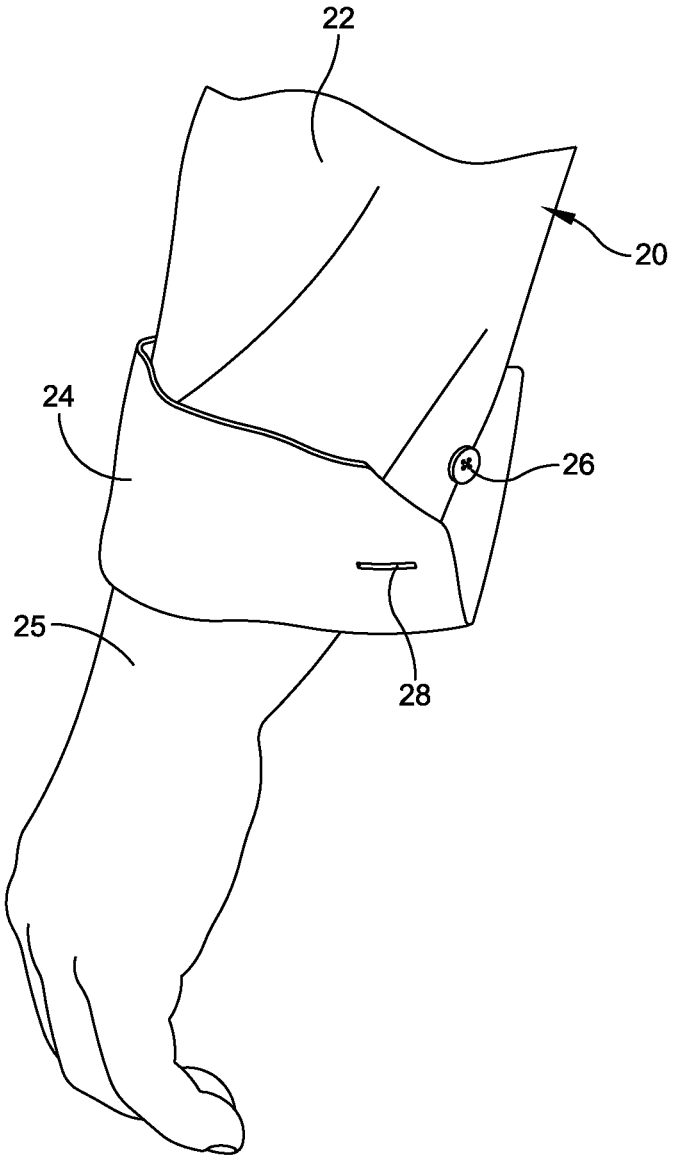
FIG. 4 is a fragmentary view showing a typical buttoned cuff folded back.

Referring now to FIG. 4, the shirt 20 is shown as having a sleeve 22 and a cuff 24 that is folded back so that the button 26 is facing inwardly toward the shirt sleeve. FIG. 4 also shows the cuff 24 relative to the user's arm 25 and furthermore illustrates the cuff button hole at 28.

Figure 8:
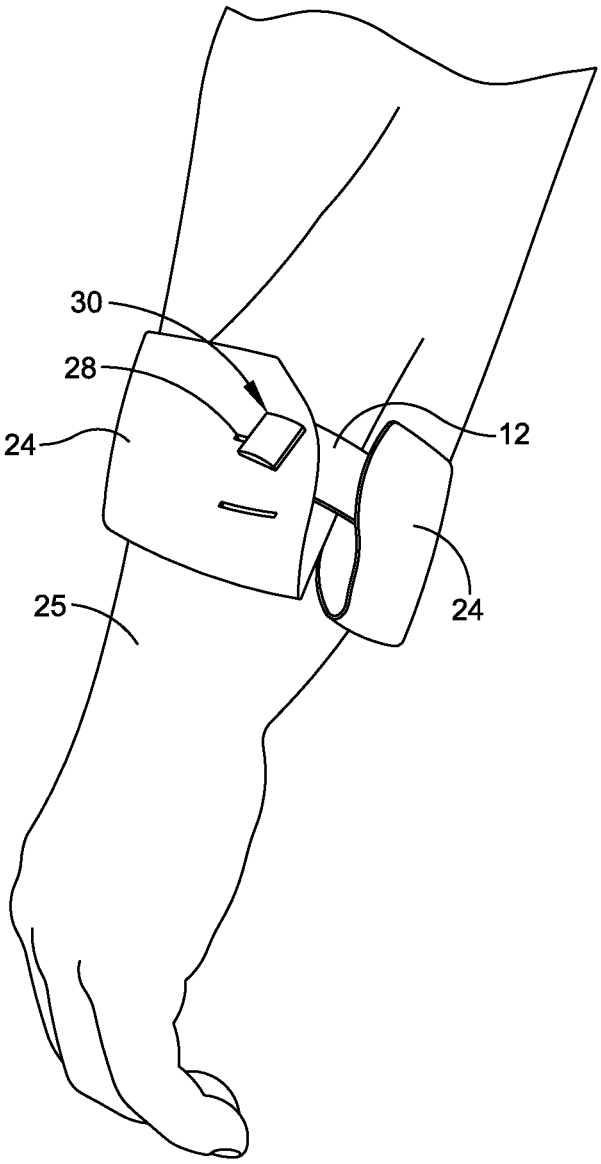
FIG. 8 is an illustration of the accessory as installed with a buttoned cuff.

FIG. 5 illustrates the accessory 10 at a first installation step wherein the slit 17 engages the button 26. The button 26 may be initially pushed through the slit 17 and then positioned as shown in FIG. 5. This will secure the accessory in the position shown in FIG. 5. FIG. 5 also illustrates the cuff link 30 with the post 32 passing through the button hole 28. The cuff link 30 also includes a toggle 34 supported at the free end of the post 32. The post 32 is secured to the ornamental head 36 of the cuff link 30. FIG. 5 illustrates the head 36 of the cuff link on the outside and the post 32 on the inside. The accessory 10 is folded over so that the post 32 can engage with the slit 15 in the accessory 10. For this purpose the toggle 34 is maintained in an inline position with the post 32 such as illustrated in FIG. 6. FIG. 7 illustrates the cuff link 30 having been passed through the button hole 28 and also engaged with the slit 15 in the base member 12. FIG. 8 illustrates the final position of the cuff link with the ornamental head 30 facing outwardly thus providing an appearance as though a cuff link is applied to a buttoned cuff shirt.

Figure 9:
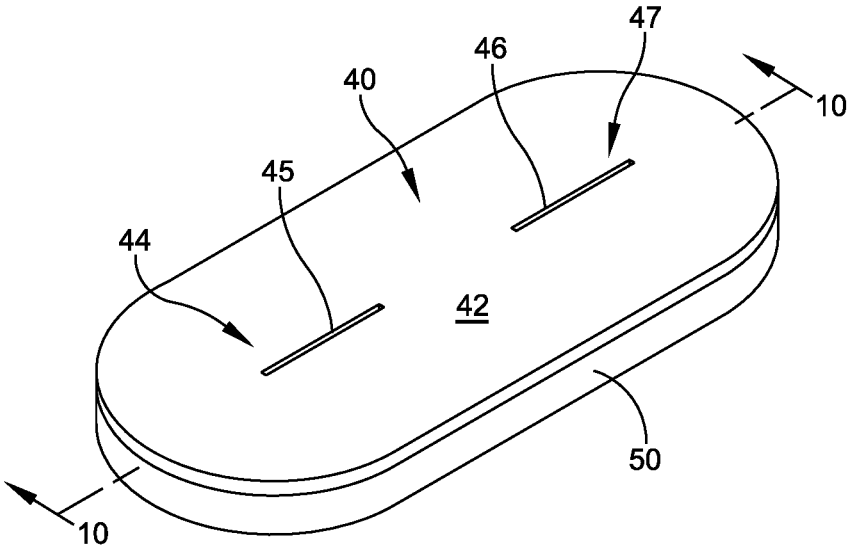
FIG. 9 is a perspective view of an alternate embodiment of the cuff link accessory.
Figure 10:
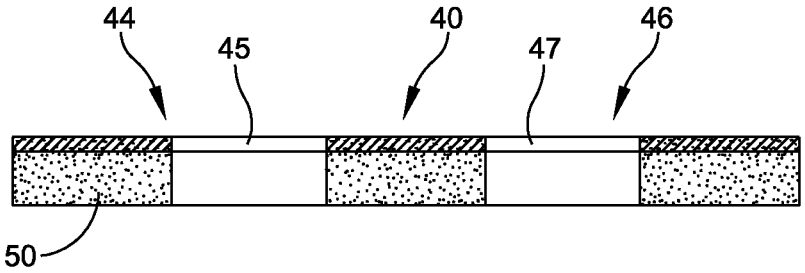
FIG. 10 is a cross section view taken along line 10-10 of FIG. 9.

Reference is now made to FIGS. 9 and 10 for an alternate embodiment of the present invention. This is in the form of an accessory 40 that includes a base member 42 and opposite hole sections 44 and 46 having respective slits 45 and 47. The embodiment shown in FIGS. 9 and 10 similar to that shown in FIGS. 1-3 but further includes a substrate 50 that may be constructed of a soft pliable material such as a foam material. As this material will be pressed against the user's skin, it may be advantageous to have a soft material at that location.

Figure 11:
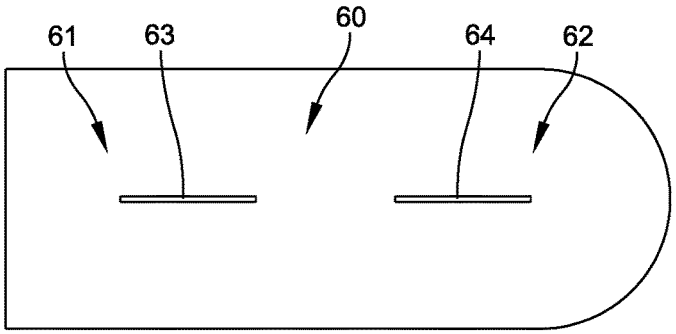
FIG. 11 is a plan view of a second embodiment of the cuff link accessory.

Reference is now made to FIGS. 11-14 for alternate embodiments of the present invention. FIG. 11 illustrates a base member 60 having hole sections 61 and 62 with respective slits 63 and 64. In this embodiment the hole section 61 is rectangular while the hole section 62 is circular.

Figure 12:
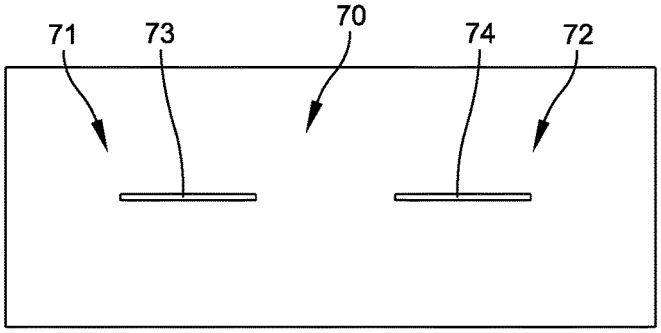
FIG. 12 is a plan view of a third embodiment of a cuff link accessory.

In the embodiment of FIG. 12, there is shown a base member 70 having opposed hole sections 71 and 72 with respective slits 73 and 74. In FIG. 12 both of the hole sections are square off so as to form a substantially rectangular base member.

In FIG. 13, the construction of the base member is substantially the same as illustrated in FIG. 11. Thus, in FIG. 13, there is provided a base member 80 having opposed hole sections 81 and 82. In the section 81 there is provided a slit 83 while in the section 82 there is provided a circular hole 84. In accordance with the present invention, there can be a variety of shapes of the base member and there can also be a variety of shapes of the particular holes.

Figure 14:
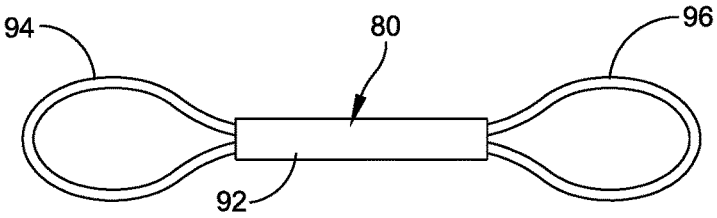
FIG. 14 is a plan view of a fifth embodiment of the cuff link accessory.

FIG. 14 shows still another embodiment of the present invention including a center section 92. From the center section 92, there are disposed opposed loops 94 and 96. These loops 94 and 96 form essential first and second hole sections that can engage respectively with the cuff link and cuff button.

Finally, FIG. 15 is a front view of the cuff link accessory of FIG. 1. FIG. 16 is a rear view of the cuff link accessory of FIG. 1. FIG. 17 is a left side view of the cuff link accessory of FIG. 1. FIG. 18 is a right side view of the cuff link accessory of FIG. 1.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A combination of a folded back shirt cuff of a shirt that has, on the shirt cuff, an inwardly facing button on one side and a hole on an opposed side thereof, a one piece cuff link having a head and a post extending from the head, and a cuff link accessory bridged across the shirt cuff between the button and hole, said cuff link accessory for coupling between the button of the folded back shirt cuff and the hole in the folded back shirt cuff, said cuff link accessory including a base member having opposed ends, a first hole section disposed at one end of the base member and a second hole section disposed at the opposed end of the base member, said first hole section constructed and arranged for engagement with the post of the cuff link, once inserted through the button hole, said second hole section constructed and arranged for engagement with the shirt cuff button.

2. The combination of claim 1 wherein the base member comprises a planar substrate constructed of a pliable material.

3. The combination of claim 2 wherein the first and second hole sections are each comprised of a single hole.

4. The combination of claim 3 wherein the single hole is in the form of an elongated slit, and the post of the cuff link engages with the first slit while the shirt button engages with the second slit.

5. The combination of claim 3 wherein at least one of the single holes is in the form of a substantially circular hole.

6. The combination of claim 5 wherein the base member comprises a planar substrate constructed of a pliable material and the diameter of the circular hole is less than a diameter of the shirt cuff button so that the shirt cuff button is engageable with the substantially circular hole and retained thereby.

7. The combination of claim 1 wherein the base member comprises a center member and the hole sections are comprised of respective end loops supported from opposite ends of the center member.

8. The combination of claim 1 wherein the base member is arranged under the folded back shirt cuff.

9. The combination of claim 8 wherein, upon the shirt cuff being folded back, the shirt cuff button is disposed under the folded back shirt cuff and between the folded back shirt cuff and a shirt sleeve from which the shirt cuff extends.

10. The combination of claim 9 wherein the cuff link is comprised of an ornamental face piece attached to the post at one end thereof and a toggle hinged from the post at an opposite end thereof.

11. The combination of claim 10 wherein, when the post is engaged with the first hole section, the toggle is in line with the post, and thereafter the toggle is pivoted in order to secure the cuff link with the first hole section.

12. The combination of claim 1 wherein the cuff link is comprised of an ornamental face piece attached to the post at one end thereof and a toggle hinged from the post at an opposite end thereof.

13. The combination of claim 12 wherein, when the post is engaged with the first hole section, the toggle is in line with the post, and thereafter the toggle is pivoted in order to secure the cuff link with the first hole section.

14. The combination of claim 1 wherein the first and second hole sections are each comprised of a single hole.

15. The combination of claim 14 wherein the single holes are in linear alignment.

16. The combination of claim 15 wherein the single holes are separated from each other by a separation space.

17. The combination of claim 16 wherein the separation space is about equal to a length of each hole.

18. The combination of claim 17 wherein each hole comprises a slit.

19. The combination of claim 17 wherein each hole comprises a circular hole.

20. The combination of claim 17 wherein each hole comprises an open loop.

21. The combination of claim 1 wherein the opposed ends of the base member are both disposed within the folded back shirt cuff and between the folded back shirt cuff and a shirt sleeve from which the shirt cuff extends.

22. The combination of claim 21 wherein the first and second hole sections are each comprised of a single hole and the single holes are separated from each other by a separation space so that the single holes are unconnected, wherein the cuff has an inwardly facing side when folded that faces the shirt sleeve, and wherein the entire base member is constructed and arranged between the inwardly facing side of the cuff and the shirt sleeve.

* * * * *